US005291848A

United States Patent [19]

Wilhelm et al.

[11] Patent Number: 5,291,848

[45] Date of Patent: Mar. 8, 1994

[54] PROTECTIVE BOAT HOOD

[76] Inventors: Arlan L. Wilhelm; Bradley S. Wilhelm, both of Box 192, Surrey, N. Dak. 58785

[21] Appl. No.: 88,375

[22] Filed: Jul. 9, 1993

[51] Int. Cl.[5] ..... B63B 17/00

[52] U.S. Cl. ..... 114/361; 150/166; 114/343

[58] Field of Search ..... 114/343, 361, 344, 219; 296/136, 77.1; 150/154, 166, 167

[56] References Cited

U.S. PATENT DOCUMENTS

| | | | |
|---|---|---|---|
| 2,764,765 | 10/1956 | Woodruff, Sr. | 114/361 |
| 3,399,687 | 9/1968 | Frieder | 114/361 |
| 5,076,195 | 12/1991 | Heyne | 114/361 |
| 5,228,408 | 7/1993 | Jannausch | 114/361 |

*Primary Examiner*—Edwin L. Swinehart
*Attorney, Agent, or Firm*—Leon Gilden

[57] ABSTRACT

A flexible hood structure is arranged for securement about a bow portion of a boat, wherein the hood includes a top wall including a top wall slot extending from the rear edge of the hood, with a side wall slot directed into the side wall below the top wall slot. The top wall slot and the side wall slot accommodate boats of various sizes, wherein elastomeric tether lines extend from a rear edge of the hood for securement to an associated trailer of the boat structure. An opening directed through the side wall in adjacency to the top wall nose portion is arranged to receive the boat securement loop therethrough, as well as permitting imposing of the cradle block structure of the trailer against the associated bow of the boat.

7 Claims, 4 Drawing Sheets

PROTECTIVE BOAT HOOD

BACKGROUND OF THE INVENTION

1. Field of the Invention

The field of invention relates to protective boat cover structure, and more particularly pertains to a new and improved protective boat hood wherein the same is arranged for securement in a surrounding relationship relative to a bow portion of a boat during a trailering procedure.

2. Description of the Prior Art

Boat cover structure of various types are utilized in the prior art and exemplified by the U.S. Pat. Nos. 4,960,066; 5,076,195; 3,898,947; 4,233,414; and 4,815,412.

The instant invention attempts to overcome deficiencies of the prior art that have heretofore failed to provide for a covering structure to cover the bow portion of a boat to provide and afford protection to the bow portion of the boat during a trailering procedure preventing marring of the bow of the boat by debris generated by the trailering of the boat and in this respect, the present invention substantially fulfills this need.

SUMMARY OF THE INVENTION

In view of the foregoing disadvantages inherent in the known types of protective boat cover structure now present in the prior art, the present invention provides a protective boat hood wherein the same is directed to the covering of a bow portion of an associated boat. As such, the general purpose of the present invention, which will be described subsequently in greater detail, is to provide a new and improved protective boat hood which has all the advantages of the prior art boat cover structure and none of the disadvantages.

To attain this, the present invention provides a flexible hood structure arranged for securement about a bow portion of a boat, wherein the hood includes a top wall including a top wall slot extending from the rear edge of the hood, with a side wall slot directed into the side wall below the top wall slot. The top wall slot and the side wall slot accommodate boats of various sizes, wherein elastomeric tether lines extend from a rear edge of the hood for securement to an associated trailer of the boat structure. An opening directed through the side wall in adjacency to the top wall nose portion is arranged to receive the boat securement loop therethrough, as well as permitting imposing of the cradle block structure of the trailer against the associated bow of the boat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective boat hood which has all the advantages of the prior art boat cover structure and none of the disadvantages.

It is another object of the present invention to provide a new and improved protective boat hood which may be easily and efficiently manufactured and marketed.

It is a further object of the present invention to provide a new and improved protective boat hood which is of a durable and reliable construction.

An even further object of the present invention is to provide a new and improved protective boat hood which is susceptible of a low cost of manufacture with regard to both materials and labor, and which accordingly is then susceptible of low prices of sale to the consuming public, thereby making such protective boat hoods economically available to the buying public.

Still yet another object of the present invention is to provide a new and improved protective boat hood which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
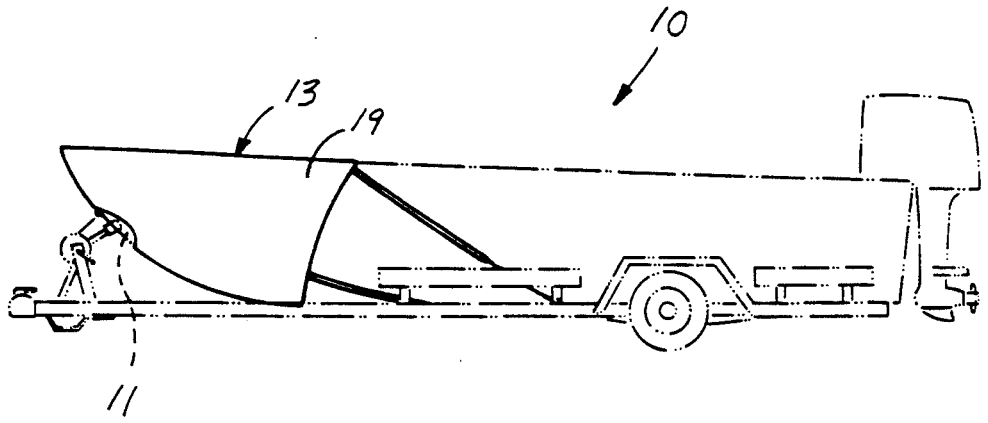
FIG. 1 is an orthographic side view of the invention in use.
Figure 2:
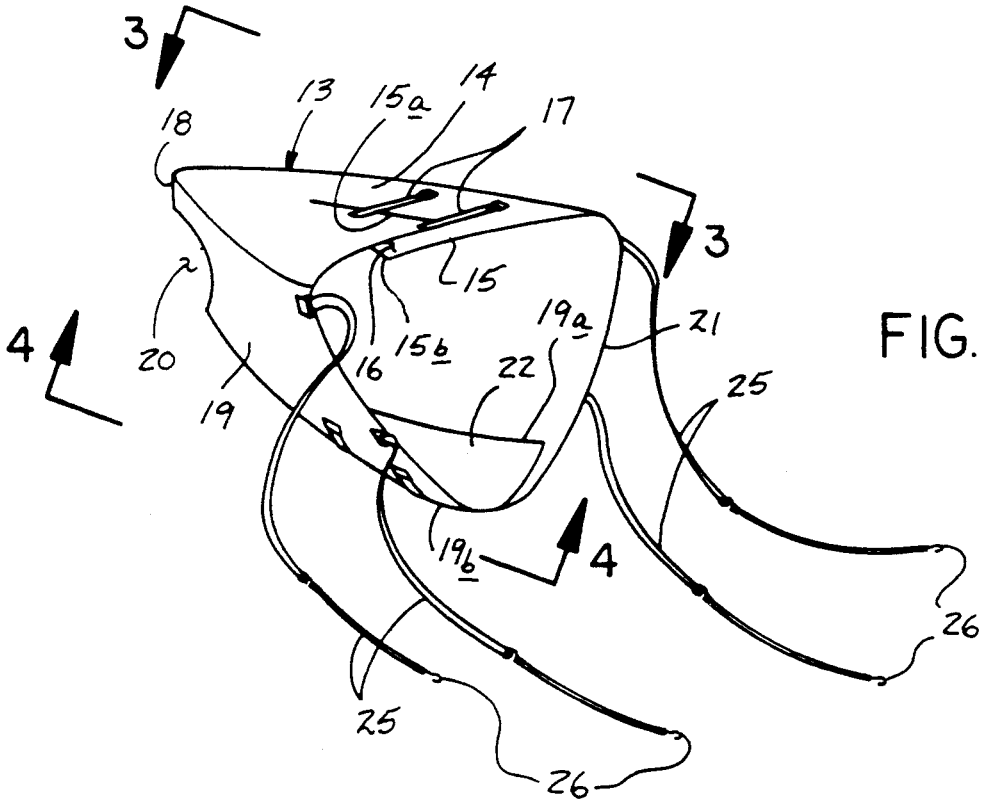
FIG. 2 is an isometric rear view of the invention.
Figure 3:
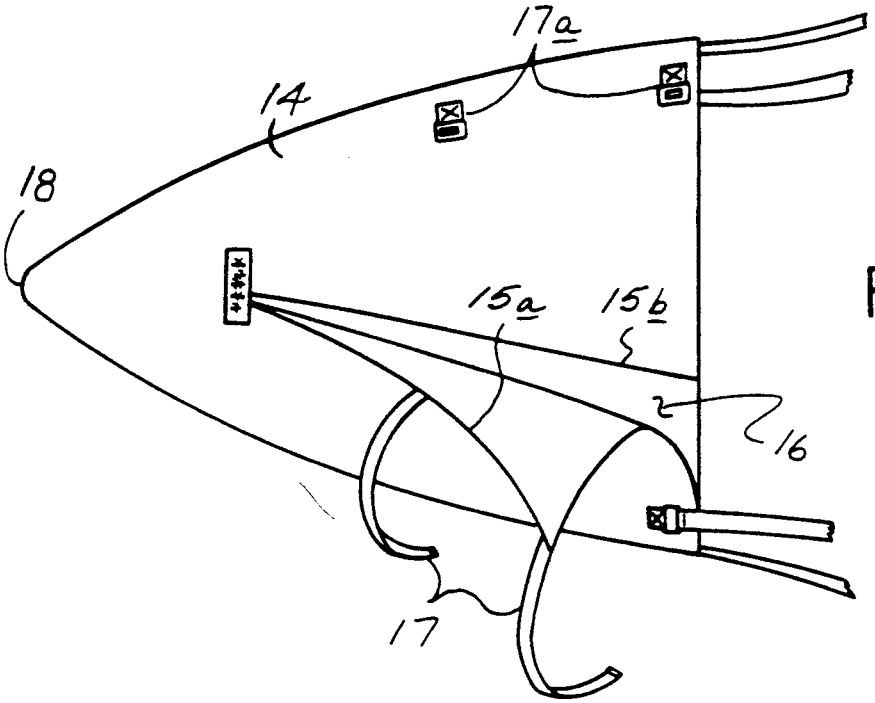
FIG. 3 is an orthographic top view, taken along the lines 3—3 of FIG. 2 in the direction indicated by the arrows.
Figure 4:
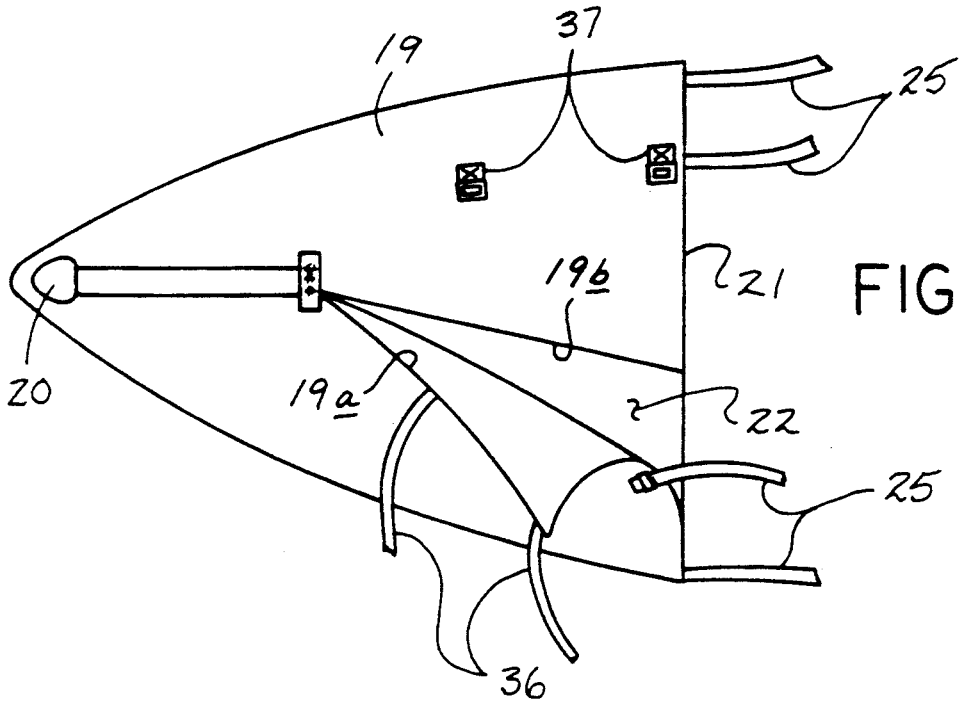
FIG. 4 is an orthographic bottom view, taken along the lines 4—4 of FIG. 2 in the direction indicated by the arrows.

With reference now to the drawings, and in particular to FIGS. 1 to 8 thereof, a new and improved protective boat hood embodying the principles and concepts of the present invention and generally designated by the reference numerals 10 and 10*a* will be described.

More specifically, the protective boat hood 10 of the instant invention essentially comprises mounting about the bow portion 11 of an associated boat that is mounted to a trailer structure, as indicated in FIG. 1. The structure includes a flexible hood 13 having a side wall opening 20 to expose the bow 11 through the opening of the hood side wall 19. The hood includes a hood top wall 14 having a top wall rear edge 15 extending from the top wall continuously to the side wall spaced from a hood or top wall nose 18. From the top wall rear edge 15 is directed a first slot 16 extending orthogonally relative to the wall rear edge 15 in a spaced relationship relative to the nose 18 defining top wall first and second flap edges 15*a* and 15*b* on opposed sides of the first slot 16. First straps 17 extend from the first flap edge 15*a* across to the top wall second flap edge 15*b* and therebeyond for securement to first buckles 17*a*. In this manner, flexure and separation of the first slot as required to accommodate the associated boat is available. The side wall 19 of the hood structure 13 includes a side wall rear edge 21 extending from the top wall rear edge 15 as noted, with the side wall rear edge 21 having a second slot 22 directed medially thereof below the first slot, wherein the second slot 22 is spaced from the side wall opening 20 that is positioned medially of the side wall in adjacency to the nose 18. The side wall 19 accordingly includes side wall first and second flap edges 19*a* and 19*b* at opposed sides of the second slot 22 employing second straps 36 mounted to the side wall portion at the second slot 22 extending beyond the side wall first flap edge 19*a*, over and beyond the side wall second flap edge 19*b* for securement to second buckles 37 of the second straps 36 (see FIG. 4). Additionally, the side wall second flap edge 19*b* for securement about smaller boats, such as canoes and the like, may over-fold this side wall and include flexible resilient lacing 23 mounted about the side wall coextensive with the side wall second flap edge 19*b* for securement thereto and to a connecting web 24 that extends coextensively with the side wall second flap edge 19*b* in spaced adjacency thereto. A plurality of elastomeric trailer straps 25 extend from the side wall rear edge 21 for securement to the associated trailer by employing a trailer strap hook 26 mounted on each free distal end of each trailer strap 25 for securement to the trailer, as indicated in FIG. 1, in any convenient point of attachment to a trailer such as to cross braces and the like as is conventionally found on associated boat trailers.

Figure 5:
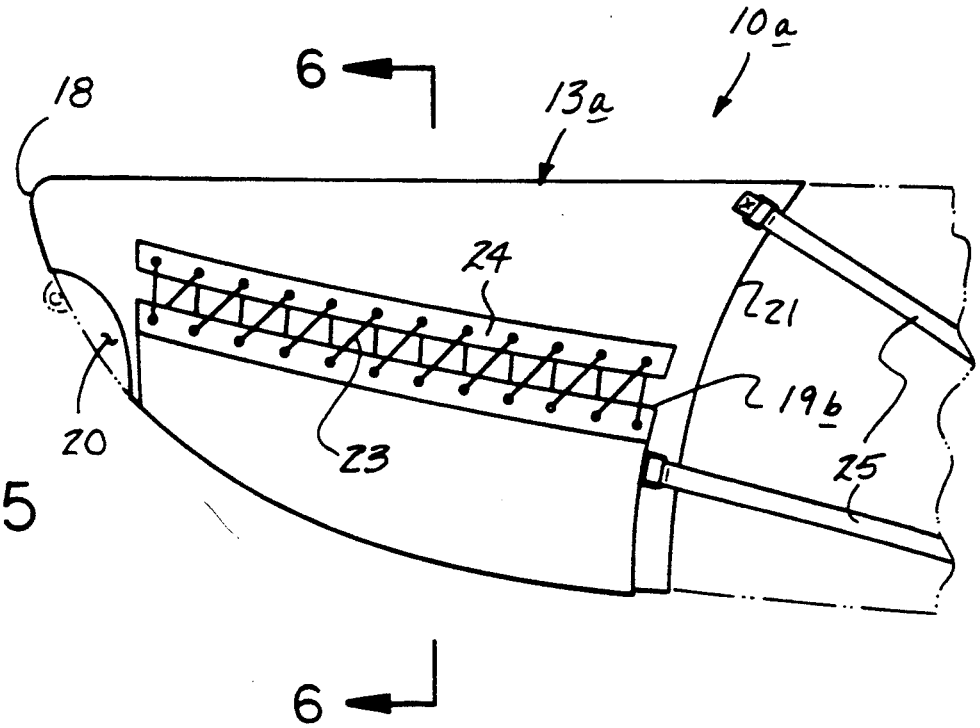
FIG. 5 is an orthographic side view of a modified side wall structure of the boat.
Figure 6:
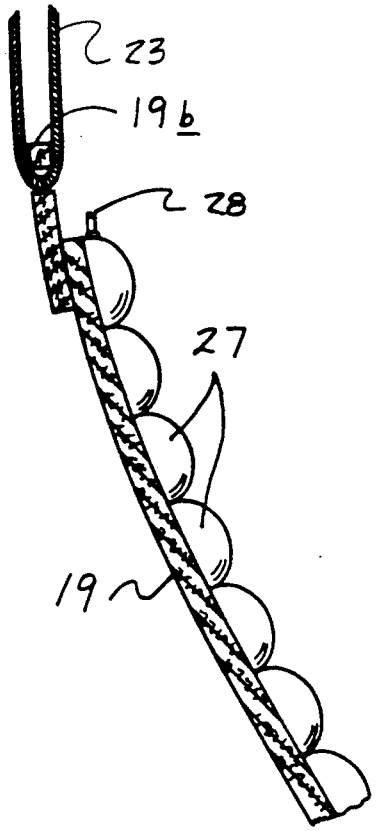
FIG. 6 is an orthographic view, taken along the lines 6—6 of FIG. 5 in the direction indicated by the arrows.

The hood structure 10*a*, as indicated in FIGS. 5 and 6, further includes a pneumatic chamber layer 27 mounted to an interior surface of the side wall coextensively therewith as affording protection to the boat, and particularly to a bottom surface of the boat, that typically receives impact during towing. An inflation tube 28 is arranged in pneumatic communication with the pneumatic chamber layer 27 for its selective inflation.

Figure 7:
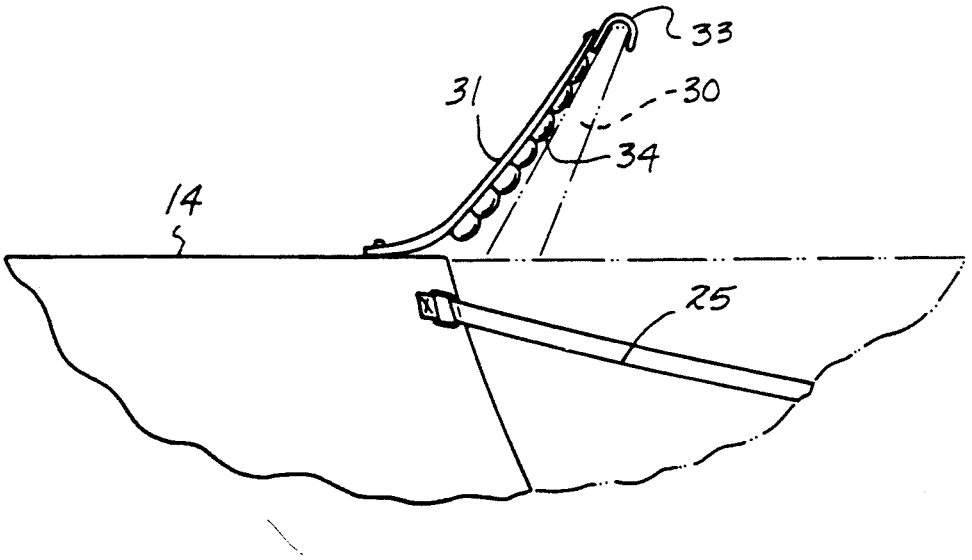
FIG. 7 is an orthographic side view of the modified hood structure employing a windshield cover flap.
Figure 8:
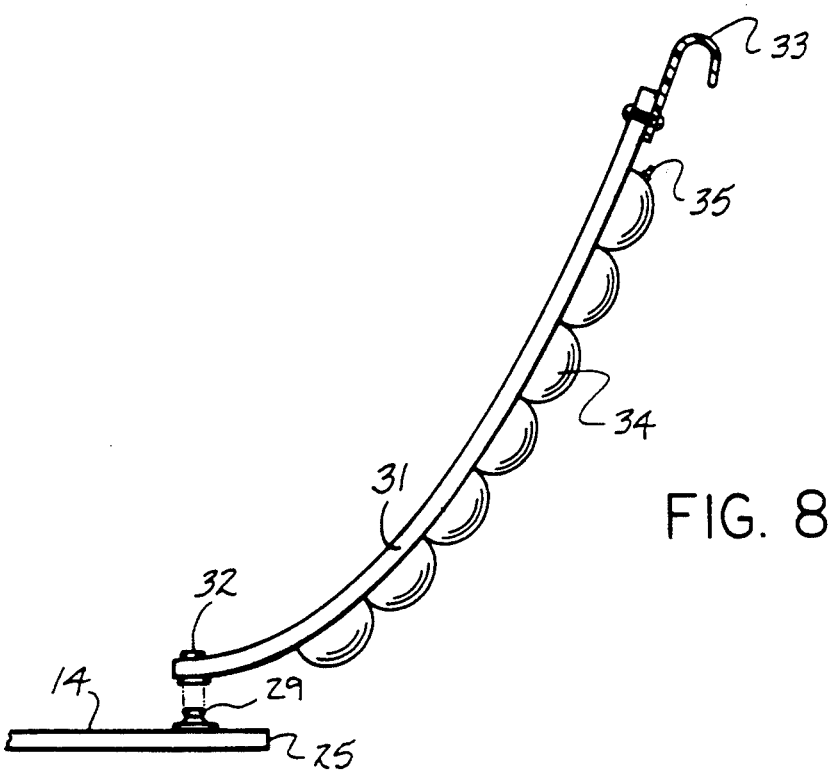
FIG. 8 is an enlarged orthographic view taken in cross-section of the windshield cover flap, as indicated in FIG. 7.

Further, reference to FIGS. 7 and 8 indicates the use of a top wall connector 29 mounted to the top wall in adjacency to the top wall rear edge 15 substantially medially thereof or alternatively, a plurality of such connectors may be employed to secure a windshield web 31 of flexible construction having a windshield web connector 32 mounted to the top wall connector 29. A hook 33 is mounted to the windshield web 31 at its outermost end spaced from its innermost end that employs the windshield web connector 32. The hook 33 or other suitable fasteners are arranged for securement about an uppermost edge of the associated boat windshield 30, as illustrated in FIG. 7. A windshield web pneumatic chamber 34 is mounted to an interior surface of the windshield web 31 in a confronting relationship relative to the windshield to provide for a cushion layer in communication with the windshield, with a further inflation tube 35 permitting selective inflation of the pneumatic chamber 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective boat hood, comprising, a flexible hood, the flexible hood having a hood top wall extending from a top wall rear edge to a top wall nose, wherein the top wall is of a generally triangular configuration, with a side wall extending from the top wall from opposed sides of the top wall, wherein the side wall includes a side wall rear edge coextensive with the top wall rear edge, with the top wall including a first slot intersecting the top wall rear edge, wherein the first slot is spaced from the top wall nose, and a second slot directed into the side wall from the side wall rear edge spaced from the top wall nose and oriented below the first slot, wherein the first slot includes a top wall first flap edge and a top wall second flap edge, and the second slot includes a side wall first flap edge and a side wall second flap edge, with first straps mounted to the top wall extending over the first slot, with first connectors arranged for securement of the first straps thereto, and second straps mounted to the side wall extending over the second slot, and the side wall including buckles arranged for securement of the second straps thereto.

2. A cover as set forth in claim 1 including a side wall opening oriented medially of the side wall in adjacency to the top wall nose for receiving a boat securement loop therethrough and permitting abutment of a trailer abutment guard of an associated trailer to a forward bow portion of an associated boat.

3. A cover as set forth in claim 2 including a plurality of elastomeric straps mounted to the side wall rear edge, with each elastomeric strap including an elastomeric strap fastener for securement of the elastomeric straps to a trailer.

4. A cover as set forth in claim 3 wherein the side wall second flap edge is arranged in a spaced, coextensive relationship relative to a connecting web mounted to the side wall, with flexible lacing mounted and wound between the side wall second flap edge and the connecting web.

5. A cover as set forth in claim 4 including a pneumatic chamber mounted to an interior surface of the side wall, wherein the pneumatic chamber includes an inflation tube for selective inflation of the pneumatic chamber.

6. A cover as set forth in claim 5 including a flexible windshield web, and a top wall connector means mounted to the top wall for securement to the windshield web, and the windshield web including a fastener member secured to the windshield web spaced from the top wall connector means, and the windshield web fastener member arranged for securement to a windshield portion of the boat.

7. A cover as set forth in claim 6 including a further pneumatic chamber of flexible construction mounted to the windshield web, having a further inflation tube for selective inflation of the further pneumatic chamber.

* * * * *